US005924559A

United States Patent [19]

Carrel et al.

[11] Patent Number: 5,924,559

[45] Date of Patent: Jul. 20, 1999

[54] MULTIUSE FUNCTION DISPLAY AND DISPENSING CARTON

[75] Inventors: Micheal Carrel, Bucyrus, Kans.; Kenneth D. Haubein, Joplin, Mo.

[73] Assignee: Jasper Foods, Inc., Jasper, Mo.

[21] Appl. No.: 09/118,869

[22] Filed: Jul. 20, 1998

[51] Int. Cl.[6] ..... B65D 5/52

[52] U.S. Cl. ..... 206/45.21; 206/45.25; 206/494

[58] Field of Search ..... 206/766, 45.21, 206/45.23, 45.25, 45.26, 45.29, 434; 221/305, 63; 229/123.2

[56] References Cited

U.S. PATENT DOCUMENTS

| | | | |
|---|---|---|---|
| 1,416,465 | 5/1922 | Harvey | 206/45.21 |
| 1,609,186 | 11/1926 | Peruzzi | 206/45.25 |
| 1,667,376 | 4/1928 | Fehrenkamp | 206/42.25 |
| 2,314,304 | 3/1943 | Brennell | 206/45.21 |
| 2,875,938 | 3/1959 | Bramhill . | |
| 3,568,911 | 3/1971 | Bebout . | |
| 4,411,382 | 10/1983 | Taub . | |
| 4,733,775 | 3/1988 | Fireman . | |
| 4,752,029 | 6/1988 | Buford . | |
| 5,284,293 | 2/1994 | Alpern et al. . | |
| 5,577,612 | 11/1996 | Chesson et al. | 206/494 |

*Primary Examiner*—Paul T. Sewell
*Assistant Examiner*—Nhan T. Lam
*Attorney, Agent, or Firm*—Larson & Taylor

[57] ABSTRACT

A multiuse carton is provided for carrying, dispensing and displaying items contained therein. The carton is formed by first and second base panels separated from each other by side walls and end walls to form an interior space in which the items are arranged in a row. The first panel includes a removable tear away element extending transversely of the carton and located at least close to one end wall for, when removed, creating an opening in the carton whereby, with the carton supported on this one end wall, the items can be dispensed one by one through the opening. The carton further includes a hinged tear away portion panel for, with the carton supported on the second base panel and the hinged tear away portion pulled back from the one end wall, exposing the packages in the carton for display. The hinged tear away portion includes an integral erectable header portion defined by a through cut line. Folding of the tear away portion about transverse fold lines on opposite sides of the header portion provides tenting of the tear away portion and erection of the erectable header portion.

18 Claims, 3 Drawing Sheets

MULTIUSE FUNCTION DISPLAY AND DISPENSING CARTON

FIELD OF THE INVENTION

The present invention relates to an improved carton for items such as small packages or bags of potato chips and the like, which is capable of serving carrying, display and dispensing uses or functions

BACKGROUND OF THE INVENTION

There are, of course, many different kinds of cartons and containers for goods or items for sale which perform more than one function. An example of a multiple function carton of this type is that dislosed in U.S. Pat. No. 2,875,938 (Bramhill). The Bramhill patent discloses a dispensing carton for cigarette packages which, in a dispensing mode, is placed in an upright orientation so that cigarette packages can be dispensed through an opening at the bottom end created by removing tear strip at this end. The cigarette packages can also be dispensed from the carton in a more conventional manner by lifting the carton lid when the carton is placed flat.

Other patents in this general field which are of possible interest include the following: U.S. Pat. Nos. 3,568,911 (Bebout); 4,11,382 (Taub); 4,733,775 (Fireman); 4,752,029 (Buford); and 5,284,293 (Alpern, et al.).

SUMMARY OF THE INVENTION

According to the invention, a carton or container is provided which has multiple uses. The carton can be used as simple carrier for packages or other items contained therein, as a dispenser wherein the packages or items can be conveniently dispensed one at a time, and as a display tray wherein the contents of the carton are displayed and an integral header portion is erected which is adapted to be used to provide information about the items contained in the carton as well as the maker and/or distributor of the items (e.g., in the form of a names, logos, advertising copy, descriptive and informational and materials and the like). All of these uses are provided by a carton which is formed or assembly from a single, integral blank and which is readily modified to serve its different functions, i.e., its dispensing or display functions.

In accordance with a preferred embodiment of the invention, a multiuse or multifunction carton is provided for carrying, dispensing and displaying items contained therein, the carton comprising: first and second side walls; first and second end walls; first and second base panels separated from each other by the side walls and end walls to form an interior space in which the items are arranged in a row in substantially parallel relation with the end walls; the first panel having sides and first and second ends and including a removable tear away element extending transversely of the carton and located at least close to the first end wall for, when removed, creating a transverse opening in the carton whereby, with the carton supported by the first end wall, the items contained within said carton can be dispensed one by one through the opening; and the carton further comprising a hinged tear away or pull away portion formed between at least part of the sides and the one end of the first base panel for, with the carton supported on the second base panel and the hinged tear away portion pulled back from the first end wall, exposing the items in the carton for display, the hinged tear away portion including an erectable header portion defined by a through cut line and fold lines extending laterally on both sides of the erectable header portion such that folding of the tear away portion about the fold lines provides tenting of the tear away portion and erection of the erectable header portion.

Advantageously, the tear away portion is defined by a perforation line or line of weakness. The perforation line preferably includes side portions extending along the sides of the first base panel and a connecting portion connecting the side portions together and extending into the first end panel. The side portions advantageously include spaced through cuts which form a jagged edge when the tear away portion is pulled back. These through cuts preferably include cuts directed inwardly at an angle from the sides of the first base panel. The connection portion of the perforation cut line advantageously includes side portions extending between the first base panel and the first end panel and connected together by an end portion.

The first end panel preferably includes a punch out tab for, when punched out, enabling gripping of the tear away portion.

Advantageously, the first base panel includes corner portions remaining at corners thereof adjacent to the second end wall when the tear away portion is pulled away, and the tear away portion includes inwardly directed through cuts in opposed lateral edges thereof for engaging these corner portions.

The tear strip is preferably defined by a perforation line extending around the tear strip. Advantageously, the tear strip includes a punch out tab at one end thereof for, when punched out, enabling gripping of the tear strip.

Other features and advantages of the invention will be set forth in, or apparent from, the detailed description of the preferred embodiments of the invention which is found hereinbelow.

BRIEF DESCRIPTION OF THE DRAWINGS

FIG. 2 is a perspective view of a carton assembled from the blank of FIG. 1 and adapted for use in carrying suitable items such as packages of popcorn, potato chips and the like;

DESCRIPTION OF THE PREFERRED EMBODIMENTS

Figure 1:
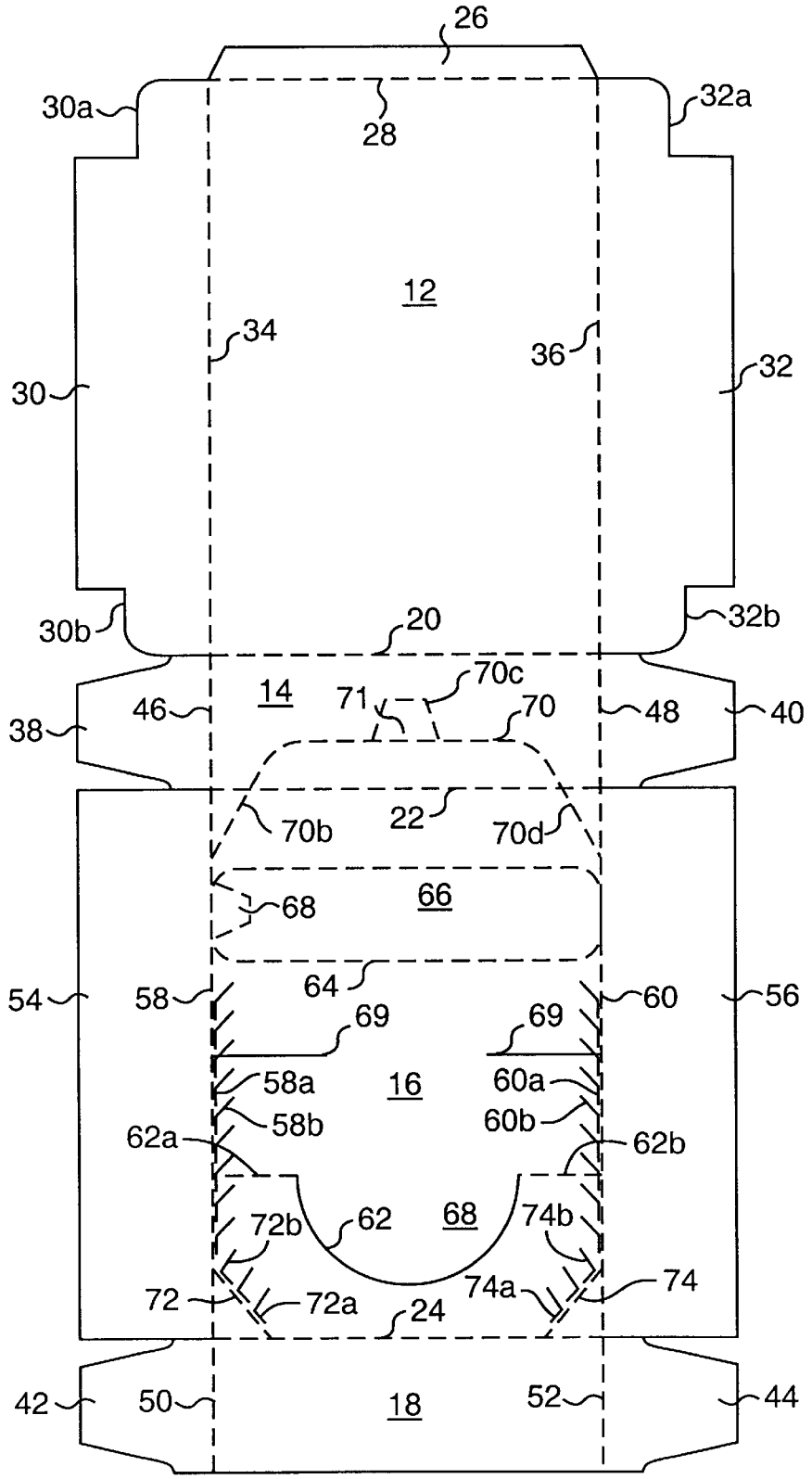
FIG. 1 is a plan view of a blank for a carton in accordance with a preferred embodiment of the invention.

Referring to FIG. 1, there is shown a blank for the carton of the invention. The blank, which is generally denoted 10 and which is made of cardboard, paperboard or other suitable material, includes a first base panel or wall 12, a first end panel or wall 14, a second base or panel wall 16 and a second end panel or wall 18, defined by respective fold or crease lines 20, 22 and 24.

An end flap 26 defined by a fold line 28 extends outwardly from one end of base panel 12 while side panels or walls 30 and 32, defined by respective fold lines 34 and 36, extend outwardly from the sides of base panel 12. Side panels 30 and 32 include respective steps 30*a,* 30*b* and 32*a,* 32*b* at opposite ends thereof.

End panels or walls 14 and 18 are substantially identical in shape, and respective side closure flaps 38, 40 and 42, 44, having stepped lateral edges as shown and defined by respective fold lines 46, 48 and 50, 52, extend outwardly from opposite sides thereof.

Side panels or walls 54 and 56, defined by respective fold lines 58 and 60, extend laterally outwardly from the second base panel or wall 16. Panels 54 and 56 are generally rectangular in shape and have substantially straight side edges.

Panel 16, which, as will become apparent, serves as the top or front wall of the carton, includes a semicircular through cut line 62 near one end thereof and a perforated cut line or line of weakness 64 near the other end thereof defining a tear strip 66. Tear strip 66 is of a generally rectangular shape with rounded ends and extends transversely across panel 16. As discussed hereinbelow, a semicircular portion 63 of panel 16 defined by through cut line 62 serves a header card or header portion in one mode of use of the carton and to this end, transverse fold or crease lines 62*a* and 62*b* are provided between the terminal ends of cut line 62 and opposites sides of panel 16. A further, generally trapezoidal shaped, perforated cut line or line of weakness 68 is located at one end of tear strip 66 which is designed to be readily punched out to make it easier to tear away the pull away or tear strip 66.

A pair of transverse through cuts 69 extend inwardly from opposite edges of base panel 16 and serve a purpose to be described below.

A further perforated cut line or perforated 70 includes a straight portion 70*a* formed in end panel 14 and first and second slant portions 70*b* and 70*c* which extend between straight portion 70*a* to the respective side edges of panel 16 formed by fold lines 58 and 60. A punch-out tab 71 is defined by a trapezoidal shaped perforated cut line or perforation line 70*c*. These side edges of panel 16 both also include a plurality of spaced through cuts 58*a* and 60*a* extending along fold lines 58 and 60 between the edge terminations of the slant portions 70*b* and 70*c* of perforated line 70 and two further slant lines 72 and 74 at the opposite end of panel 16. Slant lines 70 and 72 are formed by respective throughcuts 72*a* and 74*a* and include further through cuts 72*b* and 74*b* extending at an obtuse angle therefrom to together form a "chevron" shaped through cut. Similarly, further through cuts 58*b* and 60*b* extend an obtuse angle with respect to through cuts 58*a* and 60*a*.

Figure 2:
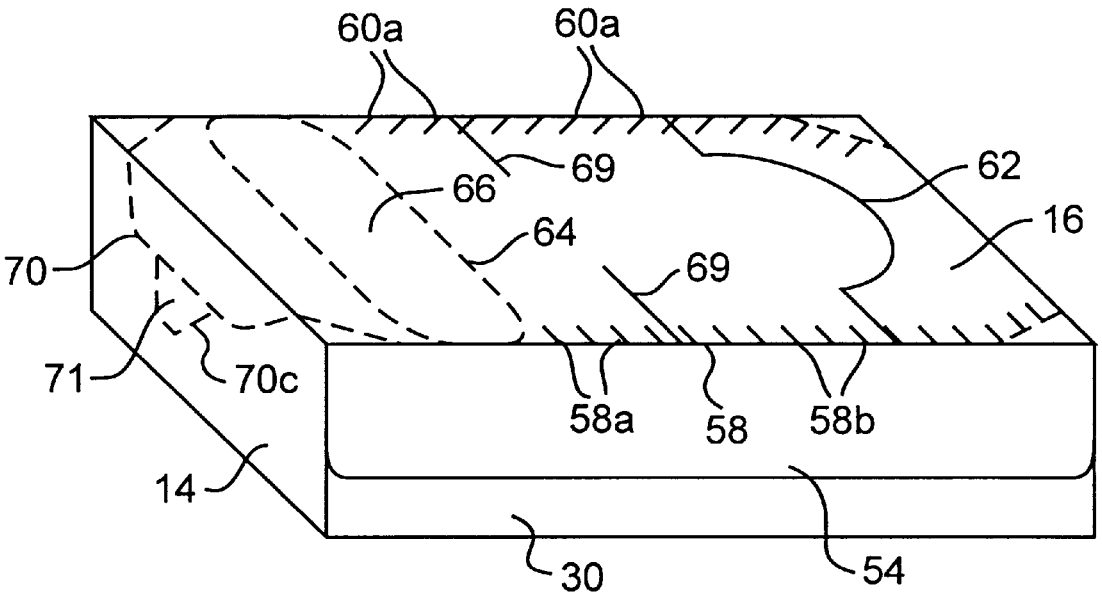

To form the base carton illustrated in FIG. 2, the panels 12, 14, 16 and 18 are folded along fold lines 20, 22 and 24 to form a box with open sides and end flap 26 is glued or to otherwise joined to end panel 18 to hold the panels together. Side closure flaps 38, 40 and 42, 44 of end panels 14 and 18, respectively, are folded along respective fold lines 46, 48 and 50, 52 so as to extend parallel to the lateral edges of panels 12, 14, 16 and 18 and are joined to side panels 30 and 32 associated with base panel 12 after these panels have been similarly folded along fold lines 34 and 36 over closure flaps 38 and 40. Side panels 54 and 56 are similarly folded along fold lines 58 and 60 over side panels 30, 32 as is shown for panels 54 and 30 in FIG. 2. These various panels are joined together to form side walls using suitable means such as glue or another adhesive.

It will be appreciated that in order to load items such as packages of, e.g., popcorn or potato chips, into the carton, one side will be left open and the packages loaded through that side and thereafter the side flaps and panels are secured together as described above. FIG. 2 thus illustrates a first mode of use of the carton of the invention, viz., as a carrier carton for multiple packages or other items.

Figure 3:
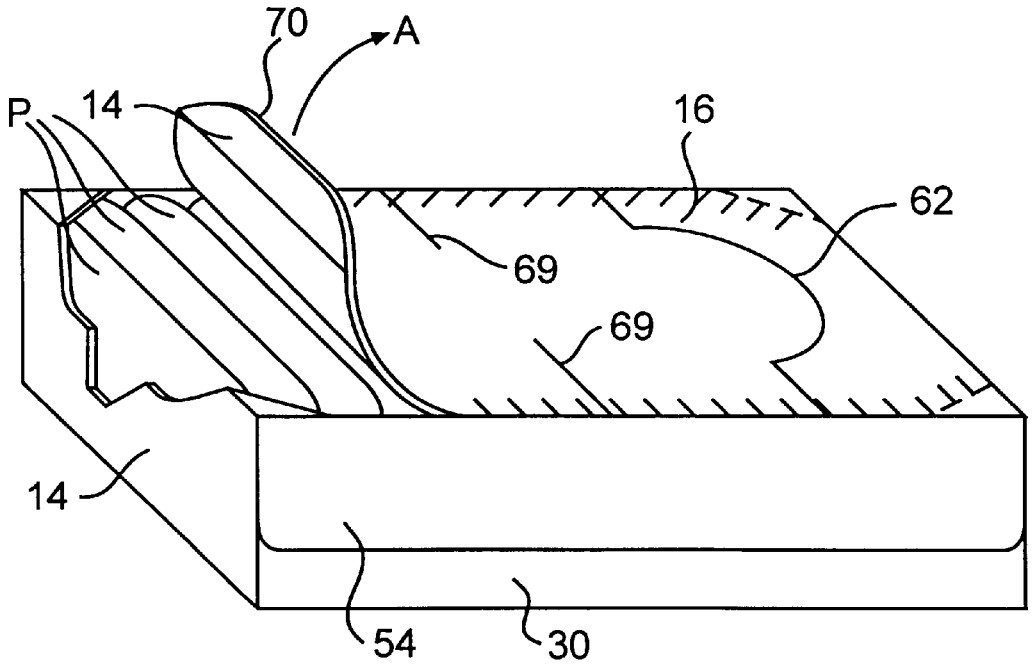
FIG. 3 is a perspective view of the package of FIG. 2, showing a step in the tearing away and pulling back of a tear away portion thereof.
Figure 4:
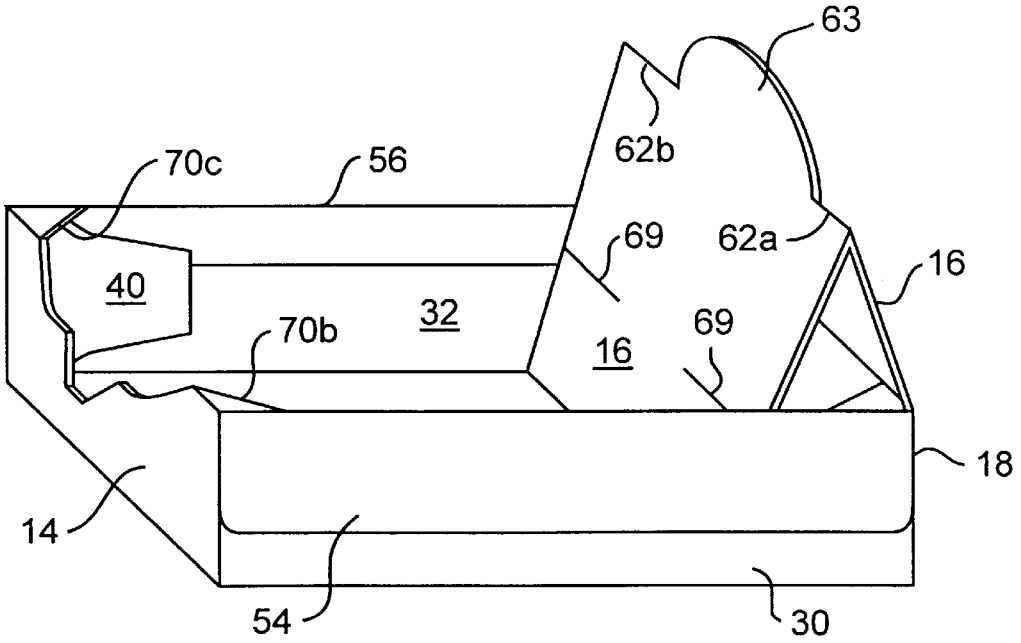
FIG. 4 is a perspective view of the package of FIG. 2 showing the tearing away and pulling back process substantially completed so that the carton forms a tray for displaying items carried thereby and the erection of an integral header portion for descriptive matter.

Referring to FIG. 3 and 4, there is illustrated a second mode of use of the carton of the invention. In this mode, the carton forms a tray and with the carton supported on base panel 12, as shown in FIG. 3, after tab 71 is depressed inwardly or otherwise punched out along perforation line 72 to create a finger grip, the carton is opened along perforated cut line 70, with a portion of end panel 14 and an adjacent portion of base (top) panel 16 being pulled backwardly in the direction of arrow A along the perforated lines created by spaced through cuts 58*a* and 60*a* so that the carton is opened at the top and the contents thereof, i.e., a series of packages P, are exposed for display As shown in FIG. 4, base panel 16 is folded along fold lines 62*a* and 62*b* so that front and back portions of base panel 16 form a tented configuration and so that header portion 63 pops up from, i.e., is erected from, the back portion of panel 16 so as to extend above the fold lines 62*a* and 62*b* in the plane of the front portion. In one embodiment, the end flap formed by the pulled back portion of end portion 14 can serve as supporting foot for the tented configuration. In this embodiment, the inwardly extending through cuts 69 can be used to engage the remaining corner portions of base panel 16 defined by slant lines 72 and 74 and thereby hold the tented front and back portions of panel 16 in place. Alternatively, the proximal part of the front portion of base panel 16 beginning at the tear strip 66 and the end flap formed by the integral portion of side panel 14 can simply be torn off and the remaining part of the front portion of base panel 16 inserted behind or between the packages (not shown in FIG. 4) in the tray formed by the carton. In either embodiment, an important purpose is to erect the header 63 and the associated front portion of panel 16 for displaying of suitable signage, e.g., company name, logo, product name and description, etc. (not shown), printed on or otherwise carried by these areas of the carton.

Figure 5:
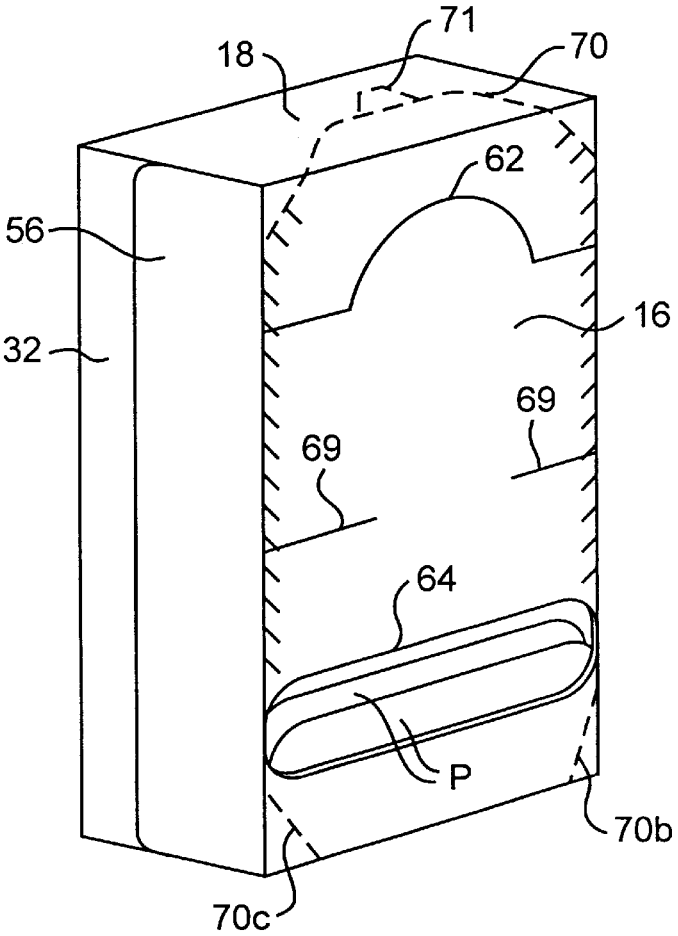
FIG. 5 is a perspective view of the carton of FIG. 2 with a tear strip thereof torn away so as to enable dispensing of items therefrom.

Referring to FIG. 5, a further mode of use is illustrated. In this mode, the carton is stood on end as illustrated, i.e., is placed in a vertical orientation, and the tear strip 66 is removed. This is done by punching out the tap formed by perforated cut line 68 to provide a finger grip and then pulling away tear strip 66 along line 64. With tear strip 66 removed, packages P can dispensed one a time through the opening defined by line 64 and created by the removal of the tear strip 66.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A multiuse carton for carrying, dispensing and displaying items contained therein, said carton comprising:

first and second side walls;

first and second end walls;

first and second base panels separated from each other by said side walls and said end walls to form an interior space in which items are arranged in a row in substantially parallel relation with the end walls; the first base panel having sides and first and second ends and including a removable tear away element extending transversely of the carton and located at least close to said first end wall for, when removed, creating an opening in said carton whereby, with said carton supported on said first end wall, the items contained within said carton can be dispensed one by one through the opening; and said carton further comprising a hinged tear away portion formed between at least part of the sides and said one end of said first base panel for, with said carton supported on said second base panel and said hinged tear away portion pulled back from said first end wall, exposing the packages in said carton for display, said hinged tear away portion including an erectable header portion defined by a through cut line, and fold lines extending laterally on both sides of said erectable header portion such that folding said tear away portion about said fold lines provides tenting of said tear away portion and erection of said erectable header portion.

2. A multiuse carton as claimed in claim 1 wherein said tear away portion is defined by a perforation line.

3. A multiuse carton as claimed in claim 2 wherein perforation line includes side portions extending along said sides of said first base panel and a connecting portion connecting said side portions together and extending into said first end panel.

4. A multiuse carton as claimed in claim 3 wherein said connection portion includes side portions extending between said first base panel and said first end panel and connected together by an end portion.

5. A multiuse carton as claimed in claim 3 wherein said first end panel includes a punch out tab for, when punched out, enabling gripping of said tear away portion.

6. A multiuse carton as claimed in claim 5 wherein said tear strip includes a punch out tab at one end thereof for, when punched out, enabling gripping of said tear strip.

7. A multiuse carton as claimed in claim 6 wherein said tear strip is defined by a perforation line extending around the tear strip.

8. A multiuse carton as claimed in claim 1 wherein said side portions include spaced through cuts which form a jagged edge when said tear away portion is pulled back.

9. A multiuse carton as claimed in claim 8 wherein said through cuts include cuts directed inwardly at an angle from the sides of said first base panel.

10. A multiuse carton as claimed in claim 1 wherein said first base panel includes corner portions remaining at corners thereof adjacent to said second end wall when said tear away portion is pulled away, and said tear away portion includes inwardly directed through cuts in opposed lateral edges thereof for engaging said corner portions.

11. A multiuse carton as claimed in claim 10 wherein said tear strip includes a punch out tab at one end thereof for, when punched out, enabling gripping of said tear strip.

12. A multipurpose carton comprising:

first and second spaced, parallel base panels each having opposite ends and lateral edges;

first and second spaced, parallel end walls formed integrally with said base panels; and first and second spaced, parallel side walls formed integrally with said base panels;

said first base panel including a tear strip located at least close to one end thereof and having a peripheral edge defined by a line of weakness so that, by rupturing the line of weakness, said tear strip can be removed from the carton so as to create an opening therein;

said first base panel further comprising an erectable header portion spaced longitudinally from said tear strip and defined by a through cut line having first and second terminal ends, and first and second fold lines extending transversely of said first panel between said respective terminal ends of said through cut line and opposed lateral edges of said first base panel;

said carton further comprising an additional line of weakness defining a hinged tear away portion, said additional line of weakness extending at least around a part of said first base panel containing said erectable header portion and said first and second fold lines, and including at least part of said one end of said first base panel and a least part of said lateral edges of said first base panel so that said additional line of weakness enables said tear away portion to be peeled back from said one end to expose the interior of the carton, and to be folded about said fold lines to provide erection of said erectable header portion.

13. A multiuse carton as claimed in claim 12 wherein said additional line of weakness includes side portions extending along said sides of said first base panel and a connecting portion connecting said side portions together and extending into said first end panel.

14. A multiuse carton as claimed in claim 13 wherein said side portions include spaced through cuts which form a jagged edge when said tear away portion is pulled back.

15. A multiuse carton as claimed in claim 14 wherein said through cuts include cuts directed inwardly at an angle from the sides of said first base panel.

16. A multiuse carton as claimed in claim 13 wherein said connection portion includes side portions extending between said first base panel and said first end panel and connected together by an end portion.

17. A multiuse carton as claimed in claim 12 wherein said first end panel includes a punch out tab for, when punched out, enabling gripping of said tear away portion.

18. A multiuse carton as claimed in claim 12 wherein said tear strip includes a punch out tab at one end thereof for, when punched out, enabling gripping of said tear strip.

* * * * *